US008840272B2

(12) United States Patent
Manning

(10) Patent No.: US 8,840,272 B2
(45) Date of Patent: Sep. 23, 2014

(54) TARGET LIGHTING APPARATUS

(71) Applicant: Jon Manning, Taylor, TX (US)

(72) Inventor: Jon Manning, Taylor, TX (US)

( * ) Notice: Subject to any disclaimer, the term of this patent is extended or adjusted under 35 U.S.C. 154(b) by 29 days.

(21) Appl. No.: 13/769,377

(22) Filed: Feb. 17, 2013

(65) Prior Publication Data

US 2013/0215324 A1 Aug. 22, 2013

Related U.S. Application Data

(60) Provisional application No. 61/600,167, filed on Feb. 17, 2012.

(51) Int. Cl.
*F21S 8/08* (2006.01)
*F21V 21/30* (2006.01)

(52) U.S. Cl.
CPC ..... *F21V 21/30* (2013.01)
USPC ..... 362/269; 362/249.02; 362/249.07; 362/369; 362/419

(58) Field of Classification Search
CPC ..... F21S 2/00; F21S 6/00; F21S 8/00; F21S 8/06; F21V 14/00; F21V 21/00; F21V 21/08; F21V 21/14; F21V 21/26; F21V 21/30; F21V 33/00; F21V 33/52; G03B 15/02; G03B 21/00; G03B 21/26
USPC ..... 362/3, 11, 18, 238–245, 249.01, 362/249.02, 249.03, 249.07, 249.1, 249.11, 362/269–272, 276, 285, 287, 368–372, 384, 362/418, 419, 427
See application file for complete search history.

(56) References Cited

U.S. PATENT DOCUMENTS

| | | | | |
|---|---|---|---|---|
| 3,856,251 | A * | 12/1974 | Miller | 248/205.1 |
| 4,482,325 | A | 11/1984 | Reimann | |
| 4,890,847 | A | 1/1990 | Cartee et al. | |
| 5,023,755 | A * | 6/1991 | Rosenberg | 362/12 |
| 5,207,747 | A * | 5/1993 | Gordin et al. | 362/233 |
| 5,313,378 | A * | 5/1994 | Gordin et al. | 362/655 |
| 5,533,732 | A | 7/1996 | Leiner, Sr. et al. | |
| 5,618,044 | A | 4/1997 | Bateman | |
| 6,666,570 | B2 * | 12/2003 | Canuel | 362/419 |
| 7,476,006 | B2 * | 1/2009 | Hinds | 362/286 |
| 7,922,353 | B2 * | 4/2011 | Isely | 362/231 |
| 8,191,302 | B1 * | 6/2012 | Swan | 42/114 |

(Continued)

FOREIGN PATENT DOCUMENTS

| | | | | |
|---|---|---|---|---|
| FR | 2592845 | A1 * | 7/1987 | B60Q 1/30 |
| JP | 2004-138294 | A | 5/2004 | |

*Primary Examiner* — Hargobind S Sawhney
(74) *Attorney, Agent, or Firm* — Hulsey Calhoun, P.C.; William Hulsey, III

(57) ABSTRACT

A target lighting apparatus having a tray seating one or more light bulbs connected to a deflector, which is attached to one or more shock-absorbing arms, such that the deflector blocks the tray from any projectiles and the shock-absorbing arms absorb the impact of projectiles that come in contact with the deflector. In some embodiments, the tray, the one or more light bulbs, the deflector and the one or more shock-absorbing arms form a second frame which is adjustably connected to a base frame such that the second frame can slide from the back of the base frame to the front of the base frame and can rotate about an axis along the front of the base frame from a closed position to an open position. The one or more light bulbs are powered by a battery pack. The battery pack may be solar charged by solar panels.

21 Claims, 3 Drawing Sheets

(56) References Cited

U.S. PATENT DOCUMENTS

| | | | | |
|---|---|---|---|---|
| 8,360,597 | B1 * | 1/2013 | Hanchett | 362/190 |
| 2003/0086273 | A1 * | 5/2003 | Canuel | 362/419 |
| 2008/0225534 | A1 * | 9/2008 | Rus et al. | 362/404 |
| 2008/0253138 | A1 * | 10/2008 | Katz et al. | 362/427 |
| 2009/0168412 | A1 * | 7/2009 | Murphy | 362/202 |

* cited by examiner

TARGET LIGHTING APPARATUS

CROSS-REFERENCE TO RELATED APPLICATIONS

This application claims priority to U.S. Provisional Application Ser. No. 61/600,167, which is hereby incorporated by reference.

FIELD OF THE INVENTION

The invention relates to target lighting devices.

BACKGROUND OF THE INVENTION

There is a long history of target shooting both professionally and recreationally. Not surprisingly, a variety of different targets exist, from archery blocks to silhouettes and three-dimensional targets for target practice with guns. Additionally, many targets have markings on them to allow for accuracy and precision practice, and some come in different shapes for the same purpose. In response to a desire to shoot targets during the night time or otherwise in the dark, some targets utilize glow-in-the-dark material or paint. Additionally, target lighting devices such as flashlights and electrical lamps are used to help visibility of the target at night. Other target lighting devices use lights to project the image of a target onto a backdrop. Many target lighting devices are large and expensive. Many target lighting devices involve permanent installation.

The approaches described in this section could be pursued, but are not necessarily approaches that have been previously conceived or pursued. Therefore, unless otherwise indicated herein, the approaches described in this section are not prior art to the claims in this application and are not admitted to be prior art by inclusion in this section.

BRIEF SUMMARY OF THE INVENTION

The disclosed subject matter relates to a target lighting apparatus.

A first aspect of the disclosed subject matter provides a base frame having a second frame adjustably connected to the base frame. The second frame comprising a tray rotatably attached to a deflector, and the deflector attached to one or more shock-absorbing arms, such that the deflector blocks the tray from any projectiles and the shock-absorbing arms absorb the impact of projectiles that come in contact with the deflector. Wherein the tray seats one or more light bulbs. Wherein the one or more light bulbs are powered by a battery pack.

In some embodiments of the disclosed subject matter one or more guide rails are used to adjustably connect the second frame to the base frame.

In other embodiments of the disclosed subject matter, a first locking system is used to secure the second frame at any position.

In yet other embodiments of the disclosed subject matter, the deflector is designed to deflect projectiles away from the user.

In yet other embodiments of the disclosed subject matter, the tray also seats one or more pin lights powered by the battery pack.

In yet other embodiments of the disclosed subject matter, the tray also seats a camera powered by the battery pack.

In yet other embodiments of the disclosed subject matter, a counterweight is rotatably attached to the second frame such that the apparatus is balanced and stable even when the second frame is in a semi-open or open position.

In yet other embodiments of the disclosed subject matter, the battery pack is solar charged via one or more attached solar panels.

In yet other embodiments of the disclosed subject matter, a transmitter and receiver is used to facilitate remote control of the one or more light bulbs, the one or more pin lights, and/or the camera.

In yet other embodiments of the disclosed subject matter, the battery pack, the solar panels, and/or the transmitter are attached to the counterweight.

In yet other embodiments of the disclosed subject matter, a second locking system is used to secure the tray in any position.

In yet other embodiments of the disclosed subject matter, one or more mounts are attached to the base frame to allow the apparatus to securely attach to various surfaces.

In yet other embodiments of the disclosed subject matter, the base frame is adjustable, for example spring-tension adjustable, to allow for secure mounting on surfaces of various sizes and shapes.

In yet other embodiments of the disclosed subject matter, the mounts are clips, hooks, or clamps.

In yet other embodiments of the disclosed subject matter, the pin light is a laser.

In yet other embodiments of the disclosed subject matter, the camera sends live video to a computer or a smart phone.

In yet other embodiments of the disclosed subject matter, the apparatus is constructed primarily of steel.

These and other aspects of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the following FIGURES and detailed description. It is intended that all such additional systems, methods, features and advantages that are included within this description, be within the scope of any claims filed later.

BRIEF DESCRIPTIONS OF THE DRAWINGS

The novel features believed characteristic of the disclosed subject matter will be set forth in the claims. The disclosed subject matter itself, however, as well as a preferred mode of use, further objectives, and advantages thereof, will best be understood by reference to the following detailed description of illustrative embodiments when read in conjunction with the accompanying drawings, wherein:

In the FIGURES, like elements should be understood to represent like elements, even though reference labels are omitted on some instances of a repeated element, for simplicity.

DETAILED DESCRIPTION OF ILLUSTRATIVE EMBODIMENTS

Figure 1:
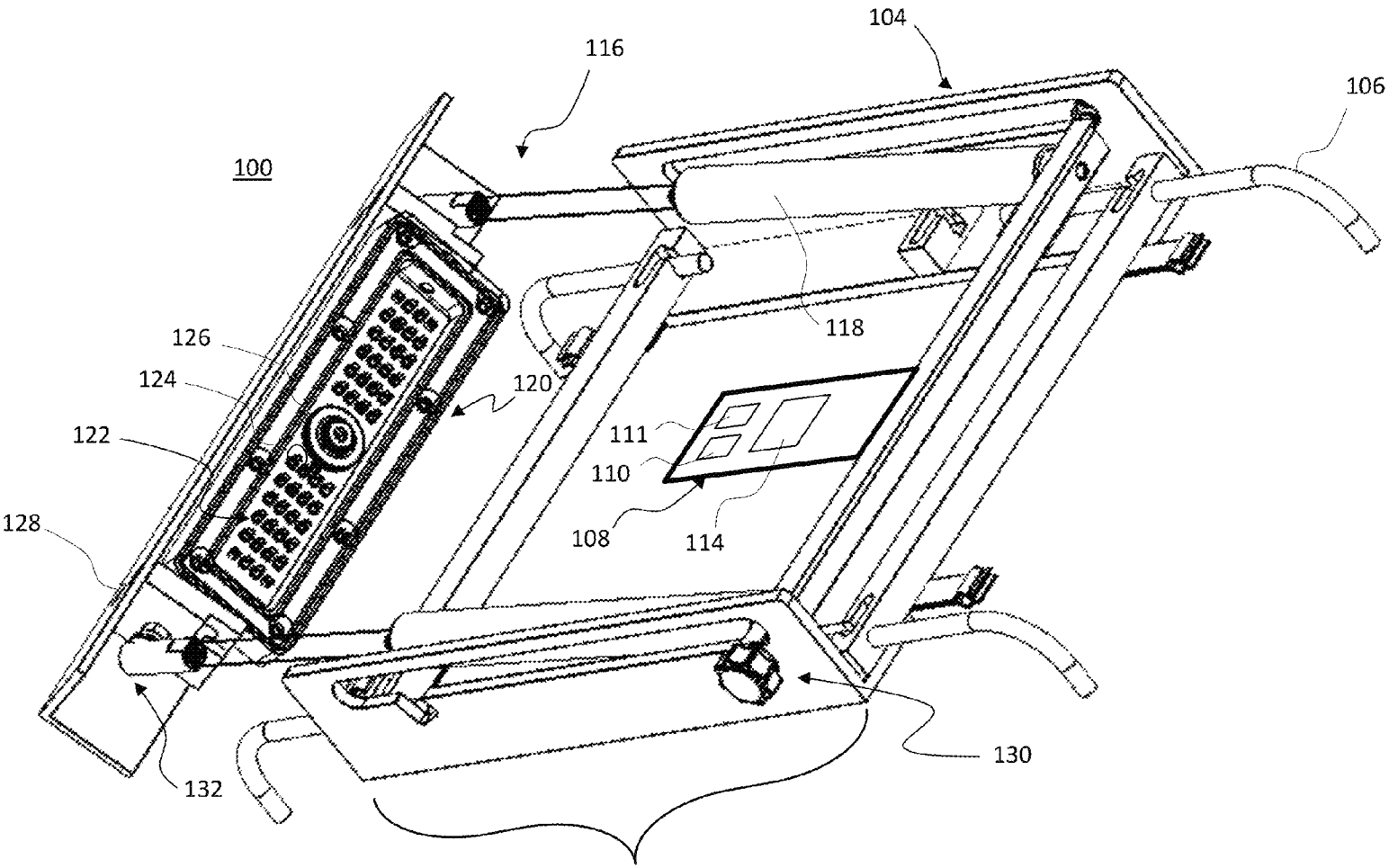
FIG. 1 depicts a perspective view of one embodiment of the target lighting apparatus positioned for use below a target.

Reference now should be made to the drawings, in which the same reference numbers are used throughout the different figures to designate the same components. FIG. 1 depicts a perspective view of one embodiment of a target lighting apparatus 100, generally comprising a base frame 102 and a second frame 116 which is generally adjustably connected to the base frame 102.

In the present embodiment, one or more guide rails 104 are used to connect the second frame 116 to the base frame 102 such that the second frame 116 is slideable from a first position at the back end of the frame to a second position at the front end of the frame, and rotatable about an axis substantially perpendicular to the guide rails 104 such that the second frame 116 can rotate from a closed position with the second frame 116 substantially collapsed on the base frame 102, to a semi-open position in which the second frame 116 has passed the point at which it is perpendicular to the base frame 102, to an open position in which the second frame 116 is substantially parallel to the base frame 102. The second frame 116 is generally secured at any position between the closed position and the open position using a first locking system 130, for example a pin, set screw, etc.

The second frame 116 generally comprises one or more shock-absorbing arms 118, a deflector 128 and a tray 120. The tray 120 generally seats one or more light bulbs 122. In other embodiments, the tray 120 may also seat one or more pin lights 124 and/or a camera 126.

The deflector 128 is attached to the one or more shock-absorbing arms 118 such that when the deflector 128 is struck by a projectile, the shock-absorbing arms 118 absorb the impact preventing destruction of the apparatus 100 and harm to the one or more light bulbs 122, the one or more pin lights 124, and the camera 126. The deflector 128 is generally designed so that projectiles will deflect away from users.

In some embodiments, a counterweight 108 may be rotatably attached to the second frame 116 such that the apparatus 100 is balanced and stable in any position, for example, when the second frame 116 is in a semi-open or open position.

A battery pack 114 is generally attached to the apparatus 100 such that the battery pack 114 is able to power the one or more light bulbs 122, the one or more pin lights 124 and the camera 126. The battery pack 114 may include any number and type of batteries that provide sufficient power to the apparatus 100, for example, six AAA batteries, etc. The battery pack 114 in some embodiments may be solar charged via one or more attached solar panels 112. A wireless transmitter 110 and a receiver 111 are included in some embodiments to allow for remote control of various aspects of the apparatus 100. In some embodiments the battery pack 114, the solar panels 112 and/or the receiver 111 may be attached to the counterweight for ease of portability and storage.

In FIG. 1, the apparatus 100 is positioned for use below a target. The second frame 116 is in a semi-open position with the tray 120 rotated such that the one or more light bulbs 122 are directed toward the target. Generally, to keep the tray 120 secure in a given position, a second locking system 132 is used, for example a pin, set screw, etc. In some embodiments, one or more mounts 106 are generally attached to the base frame 102 to allow the apparatus 100 to securely attach to various surfaces. While the mounts 106 shown in FIG. 1 are curved rods to facilitate mounting different surfaces, for example, planting into the ground, holding onto an archery block, etc., other embodiments may use other mounts 106, for example, clips, hooks, clamps, etc. In some embodiments, the base frame 102 may be adjustable, for example spring-tension adjustable, etc., to allow for secure mounting on surfaces of various sizes and shapes.

Figure 2:
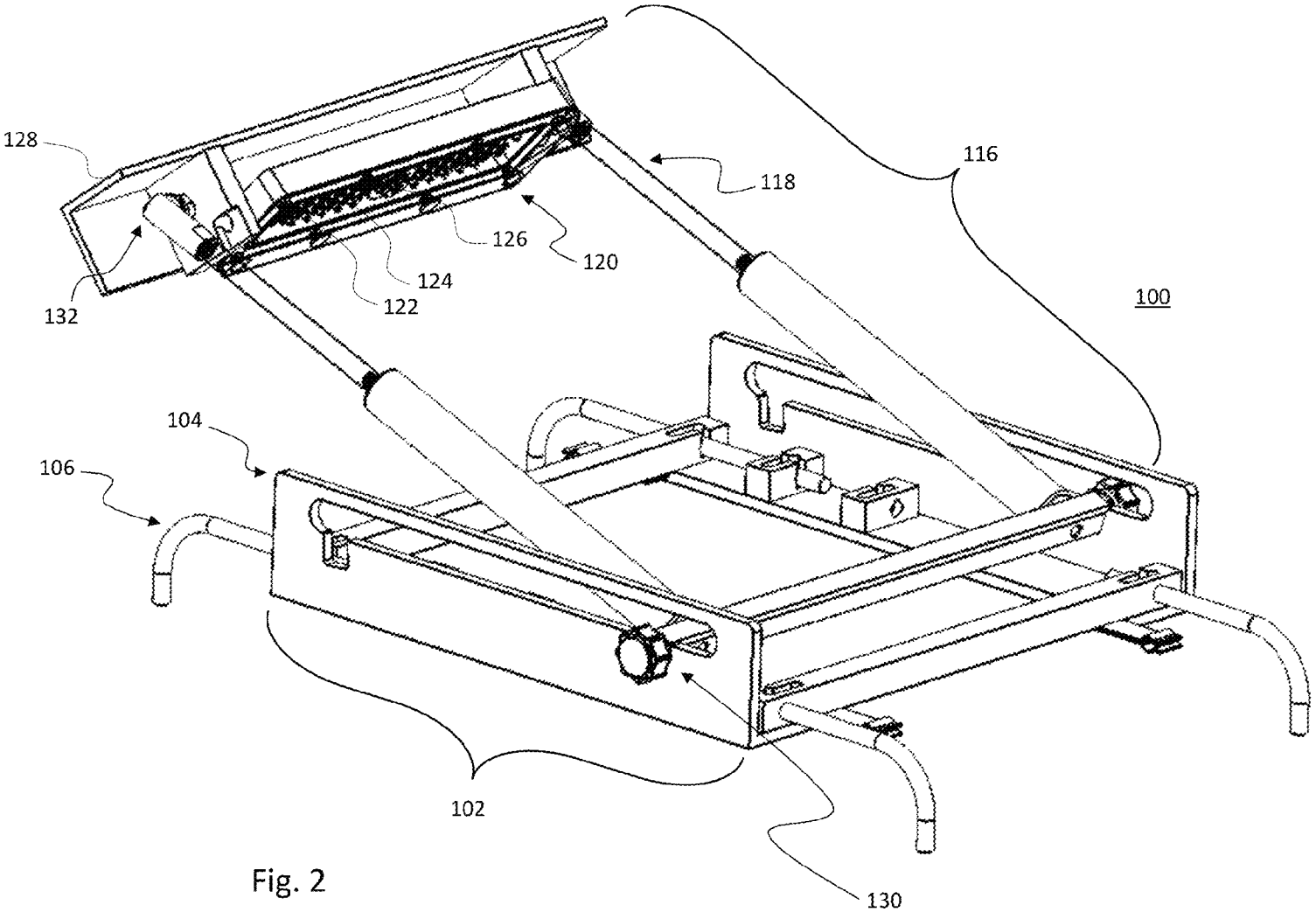
FIG. 2 depicts a perspective view of one embodiment of the target lighting apparatus positioned for use on top of a target

In FIG. 2, one embodiment of the target lighting apparatus 100 is positioned for use above a target, for example, on top of an archery block, other target block, box, etc. The apparatus 100 is set on top of the block with the mounts 106 securely attached to the block. The second frame 116 is in a semi-open position, and the tray 120 is rotated downward so that the front of the block is illuminated by the one or more light bulbs 122 and/or the one or more pin lights 124.

In some embodiments, the target lighting apparatus 100 is positioned for use with a silhouette or similar target. The apparatus 100 is set on top of, or otherwise attached with the mounts 106 to the object that holds the silhouette, whether a tree, a fence, a box, etc. The second frame 116 may be in the open position, and the tray 120 is rotated downward so that the silhouette or similar target is illuminated by the one or more light bulbs 122 and/or the one or more pin lights 124.

The FIGURES depict one embodiment of the tray 120, the one or more light bulbs 122, the one or more pin lights 124, and the camera 126. The one or more light bulbs 122 may be any number, size, brightness, color and type, for example, 48-450 lumens, clear, LED light bulbs. The one or more pin lights 124 can be any color, for example red, blue, green, etc., and can be any type of light that is capable of producing at least a small dot on the target to create additional target points for additional accuracy or precision challenges, for example a laser light etc. In some embodiments the one or more pin lights 124 may be adjustable such that the user can control the location, size or shape of the dots created by the one or more pin lights 124 manually, with remote control, or otherwise.

The camera 126 can be any type of small camera, for example a spy camera, webcam, etc. In some embodiments the camera 126 is adjustable and can be moved to view different areas manually, by remote control, or otherwise. Additionally, in some embodiments the camera 126 sends live video to a computer or a smart phone, which may be remote from the apparatus 100. In some embodiments still, the camera 126 is capable of recording video and/or taking still photographs, which may be automatically sent or otherwise accessed by the user and any intended receiver, application, and/or device. The camera 126 may also be triggered by movement, the impact of a projectile, the sound of an impacting projectile, or other triggering device so that the camera may be powered down and save power between shots.

Additionally, in some embodiments, the one or more light bulbs 122, the one or more pin lights 124, and the camera 126 may be powered on and off or otherwise operated by remote control, for example, via a smart phone or other device. Additionally they may be powered by a battery pack, rechargeable batteries, solar panels, or any other source.

Figure 3:
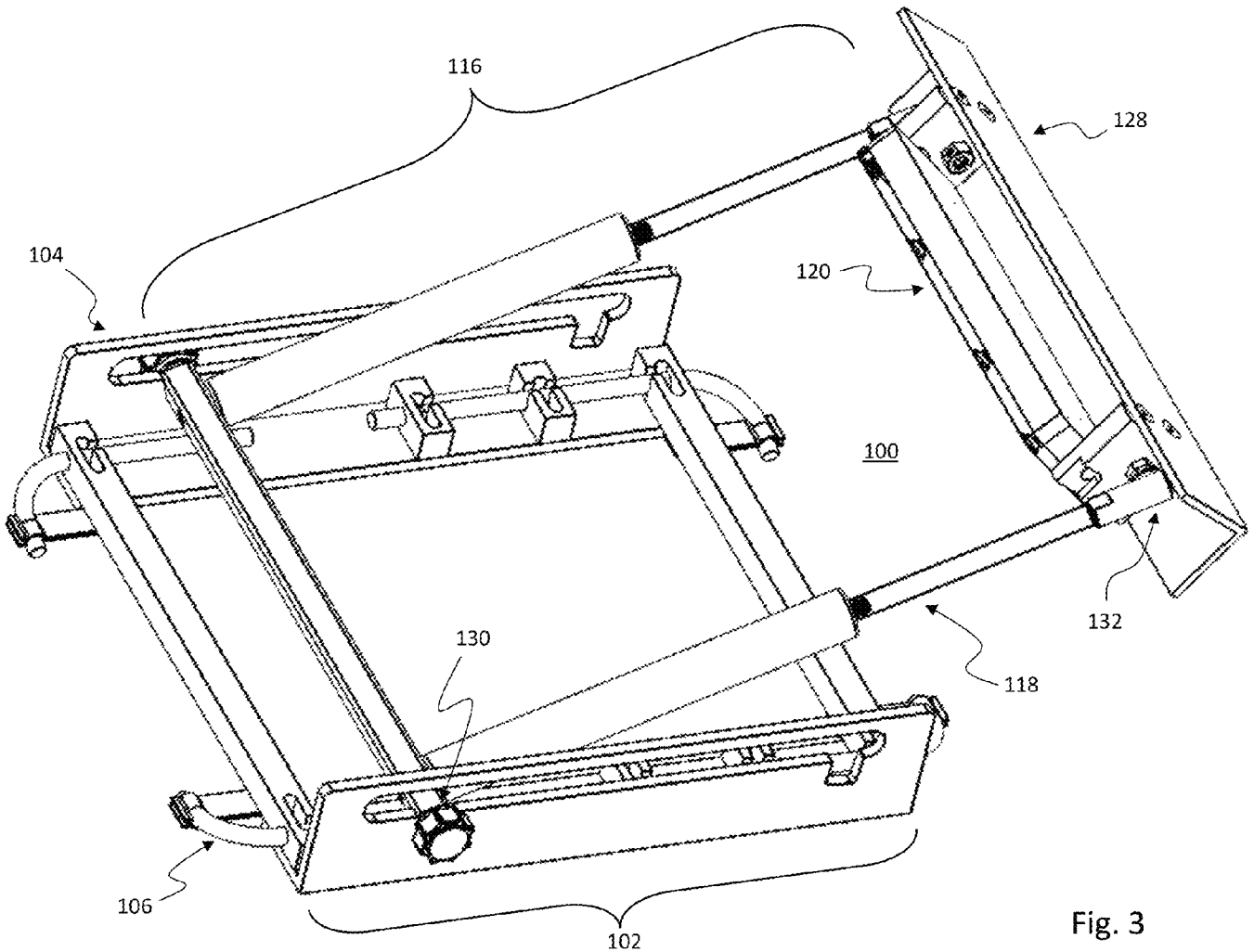
FIG. 3 depicts a perspective view of one embodiment of the target lighting apparatus with mounts collapsed.

FIG. 3 shows the mounts 106 in a collapsed position to allow the target lighting apparatus 100 to be used on surfaces where the mounts would interfere, or otherwise to be stored. In other embodiments the mounts 106 may be removable or interchangeable depending on the needs of a given position.

While in some embodiments the apparatus 100 is primarily constructed of steel so that it can withstand impact from bullets, arrows and other projectiles that might be used with targets, other embodiments may utilize other materials for any and all parts of apparatus 100, for example plastic, wood, other metals, composite materials, etc.

While the disclosed subject matter has been described with respect to a limited number of embodiments, the specific features of one embodiment should not be attributed to other embodiments of the disclosed subject matter. No single embodiment is representative of all aspects of the disclosed subject matter. Moreover, variations and modifications therefrom exist. For example, the disclosed subject matter described herein may comprise other components. Various additives may also be used to further enhance one or more properties. In some embodiments, the disclosed subject matter is substantially free of any additive not specifically enumerated herein. Some embodiments of the disclosed subject matter described herein consist of or consist essentially of the enumerated components. The claims intend to cover all such variations and modifications as falling within the scope of the disclosed subject matter.

What is claimed is:

1. A target lighting apparatus comprising:
a base frame;
a second frame comprising:
a tray;
one or more light bulbs, wherein said one or more light bulbs are seated in said tray; and
a deflector, wherein said deflector is rotatably attached to said tray to protect said one or more light bulbs from projectiles;
wherein said second frame is adjustably connected on a first side to said base frame and adjustably connected on a second side to said tray; and
wherein said apparatus is configured to illuminate the target.

2. The target lighting apparatus of claim 1, wherein said second frame further comprises one or more shock-absorbing arms connected to said deflector such that said shock-absorbing arms absorb the impact of the projectiles.

3. The target lighting apparatus of claim 1, wherein said deflector is configured to deflect the projectiles away from a user.

4. The target lighting apparatus of claim 1, further comprising a locking system configured to lock said second frame in one or more positions relative to said base frame.

5. The target lighting apparatus of claim 1, further comprising one or more pin lights seated in said tray.

6. The target lighting apparatus of claim 5, wherein at least one of said one or more pin lights is a laser.

7. The target lighting apparatus of claim 1, further comprising one or more cameras seated in said tray.

8. The target lighting apparatus of claim 7, wherein said camera is capable of transmitting live video.

9. The target lighting apparatus of claim 1, further comprising one or more counterweights rotatably attached to said second frame such that said apparatus is balanced and stable.

10. The target lighting apparatus of claim 1, further comprising a battery pack to power one or more components of said apparatus.

11. The target lighting apparatus of claim 10, further comprising one or more solar panels to charge said battery pack.

12. The target lighting apparatus of claim 10, further comprising a counterweight rotatably attached to said second frame such that said apparatus is balanced and stable, wherein said battery pack is attached to said counterweight.

13. The target lighting apparatus of claim 1, further comprising a transmitter and a receiver, wherein said transmitter and receiver are configured to facilitate remote control of at least one component of said apparatus.

14. The target lighting apparatus of claim 13, wherein the remote control is performed via a smart phone.

15. The target lighting apparatus of claim 1, further comprising one or more mounts, wherein said mounts are attached to said base frame.

16. The target lighting apparatus of claim 15, wherein said one or more mounts comprise at least one of clips, hooks, and/or clamps.

17. The target lighting apparatus of claim 1, wherein said base frame is adjustable to allow for secure mounting on surfaces of various sizes.

18. The target lighting apparatus of claim 1, further comprising a locking system configured to lock said tray in one or more positions.

19. The target lighting apparatus of claim 1, wherein said apparatus can be configured to illuminate different types of targets from different angles by adjusting the second frame relative to the base frame, and the tray relative to the second frame.

20. The target lighting apparatus of claim 1, further comprising a locking system configured to lock said tray in one or more positions.

21. A target lighting apparatus comprising:
a base frame, wherein said base frame is spring-tension adjustable;
a second frame comprising:
a tray;
a plurality of light bulbs, wherein said plurality of light bulbs are seated in said tray;
a pin light capable of creating one or more target points, wherein said pin light is seated in said tray;
a camera capable of transmitting live video, wherein said camera is seated in said tray; and
a deflector, wherein said deflector is rotatably attached to said tray to deflect projectiles away from said plurality of light bulbs, said pin light, said camera and a user; and
one or more shock-absorbing arms, wherein said shock-absorbing arms are connected to said deflector such that said shock-absorbing arms absorb the impact of the projectiles;
a first locking system configured to lock said second frame in one or more positions relative to said base frame;
a second locking system configured to lock said tray and said deflector in one or more positions relative to said second frame;
a counterweight rotatably attached to said second frame such that said apparatus is balanced and stable in various positions;
a battery pack to power at least said plurality of light bulbs, said pin light and said camera, wherein said battery pack is attached to said counterweight;
a transmitter and receiver configured to facilitate remote control of at least one component of said apparatus; and
a plurality of mounts attached to said base frame such that said spring-tension adjustable base frame and the plurality of mounts can be configured to mount a variety of surfaces;
wherein said apparatus can be configured to illuminate the target from above or below the target.

* * * * *